US005868893A

United States Patent [19]

Kipper et al.

[11] Patent Number: 5,868,893

[45] Date of Patent: Feb. 9, 1999

[54] LABEL PRINTING APPARATUS AND METHOD

[75] Inventors: Kevin L. Kipper, Middletown; Bruce E. Taylor, Tipp City, both of Ohio

[73] Assignee: Monarch Marking Systems, Inc., Dayton, Ohio

[21] Appl. No.: 857,279

[22] Filed: May 16, 1997

[51] Int. Cl.[6] ..... B65C 11/02

[52] U.S. Cl. ..... 156/277; 156/384; 156/577; 156/579; 156/DIG. 49; 242/422.5; 242/588.3

[58] Field of Search ..... 156/277, 384, 156/577, 579, DIG. 48, DIG. 49; 242/588.2, 588.3, 588.6, 422.5

[56] References Cited

U.S. PATENT DOCUMENTS

| | | | |
|---|---|---|---|
| 2,053,022 | 9/1936 | Corswandt et al. | 242/588.6 X |
| 2,373,092 | 4/1945 | Avery | 156/DIG. 33 X |
| 3,709,445 | 1/1973 | Adams | 242/422.5 |
| 4,439,257 | 3/1984 | Sato et al. | 156/277 X |
| 4,488,671 | 12/1984 | Hamisch, Jr. | 156/577 X |
| 4,776,714 | 10/1988 | Sugiura et al. . | |
| 4,826,558 | 5/1989 | Wada et al. | 156/384 |
| 5,028,155 | 7/1991 | Sugiura et al. . | |
| 5,069,557 | 12/1991 | Kuzuya et al. | 156/277 X |
| 5,279,472 | 1/1994 | Hongo et al. | 242/422.5 |
| 5,380,395 | 1/1995 | Uchida | 156/579 X |
| 5,401,352 | 3/1995 | Matsushita et al. | 156/277 Z |
| 5,486,259 | 1/1996 | Goodwin et al. . | |
| 5,487,337 | 1/1996 | Uland | 156/384 X |
| 5,713,679 | 2/1998 | Taylor . | |

FOREIGN PATENT DOCUMENTS

| | | | |
|---|---|---|---|
| 475520 | 4/1929 | Germany . | |
| 1113685 | 5/1968 | United Kingdom | 156/DIG. 48 |
| WO91/13805 | 9/1991 | WIPO . | |
| WO96/10489 | 4/1996 | WIPO . | |

*Primary Examiner*—Mark A. Osele
*Attorney, Agent, or Firm*—Joseph J. Grass

[57] ABSTRACT

There is disclosed method and apparatus which promotes effective peeling of a linerless-type label web from a roll by use of a peel roller in contact with the outer periphery of the roll. The apparatus can include a print head and a driven platen roll. The apparatus can also apply labels which are printed by the apparatus.

17 Claims, 2 Drawing Sheets

LABEL PRINTING APPARATUS AND METHOD

CROSS-REFERENCE TO RELATED APPLICATION

Reference is hereby made to co-owned U.S. patent application Ser. No. 08/727,722, filed Oct. 7, 1996 now U.S. Pat. No. 5,713,679.

BACKGROUND OF THE INVENTION

1. Field of the Invention

This invention relates to the fields of label web handling, labeling and printing.

2. Brief Description of the Prior Art

U.S. Pat. No. 5,486,259 granted Jan. 23, 1996 and assigned to Monarch Marking Systems, Inc. is prior art, the disclosure of which is incorporated herein by reference. U.S. Pat. No. 5,028,155, granted Jul. 2, 1991 and assigned to Monarch Marking Systems, Inc. is also prior art.

Linerless label webs are typically wound into rolls for subsequent use in a printer. Such linerless label webs are typically wound face-side-in. When a linerless web is drawn from the roll, the web is sometimes drawn off in a jerky manner because the point of release of the web from the roll changes. This can have a detrimental affect on printing.

SUMMARY OF THE INVENTION

This invention relates to an improved printer which can be used for printing on linerless labels and/or on labels with a liner.

It is a feature of the invention to provide an improved apparatus which enables a linerless label web to be drawn from a label roll at a controlled location rather than allowing the label web to be drawn from the roll at random locations. Absent the peel roller, separation of the linerless label web from the roll at random locations or tangent points results from unevenness of the holding force of the linerless label web to the roll. This unevenness can result from transverse perforations in the longitudinal label web.

It is a feature of the invention to provide a peel roller biased against the outer periphery of the linerless label roll which controls or establishes the location and the angle of exit of the label web from the roll. The label web is drawn from the label roll by any suitable driven roll, which can even be a platen roll of a printer. It is preferred to peel the linerless web from the label roll which is wound face-side-out so that the peel roller does not contact pressure sensitive adhesive on the underside of the label web.

The apparatus of the invention can be used with either a linerless-type label roll comprised of a linerless-type label web or a liner-type label roll comprised of a liner-type label web having labels releasably adhered by pressure sensitive adhesive to a carrier web. With a linerless-type label web, the web is passed partially about a biased peel roller and it is drawn from the label roll.

It is preferred that the peel roller be mounted for movement in constant contact with the outside of the linerless label roll so that such contact is maintained irrespective of whether the roll is full or nearly depleted.

It is a feature of the invention to provide an improved hand-held apparatus or labeler that can either print linerless labels or print and apply labels releasably adhered to a carrier web. The apparatus has a biased peel roller that acts against the outer periphery of the label roll and the label web is drawn from the label roll partially around the peel roller.

DETAILED DESCRIPTION OF THE PREFERRED EMBODIMENT

Figure 1:
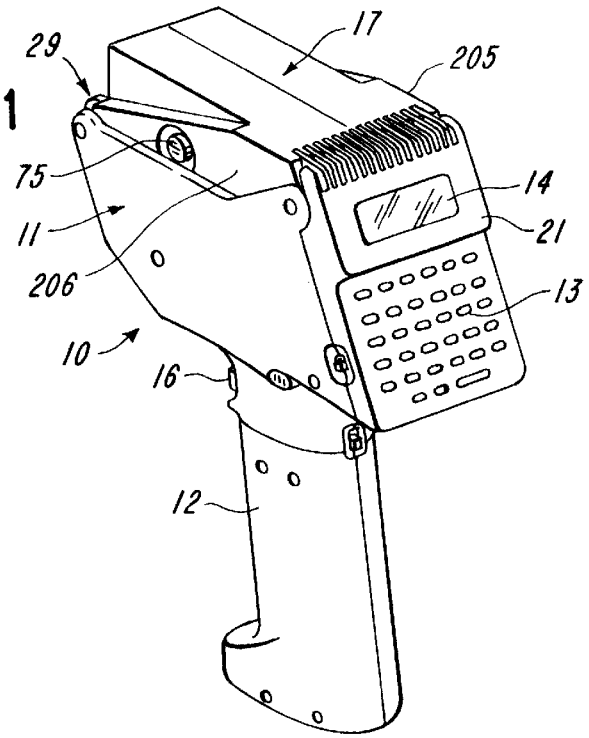
FIG. 1 is a perspective view of a hand-held apparatus embodying the invention.

Referring to FIG. 1, there is shown an apparatus, in particular a hand-held labeler, generally indicated at 10 including a housing 11, having a detachable battery-containing handle 12, a keyboard 13 and a display 14 at the rear portion of the housing 11, an applicator 29 at the front portion of the housing 11 for applying printed labels and a trigger switch 16 for operating the labeler 10. The labeler 10 has a movable housing section 21 which mounts the keyboard 13 and a movable housing section or cover 17. The cover 17 is releasably latched in the closed position by depressing buttons including the button 75.

Figure 2:
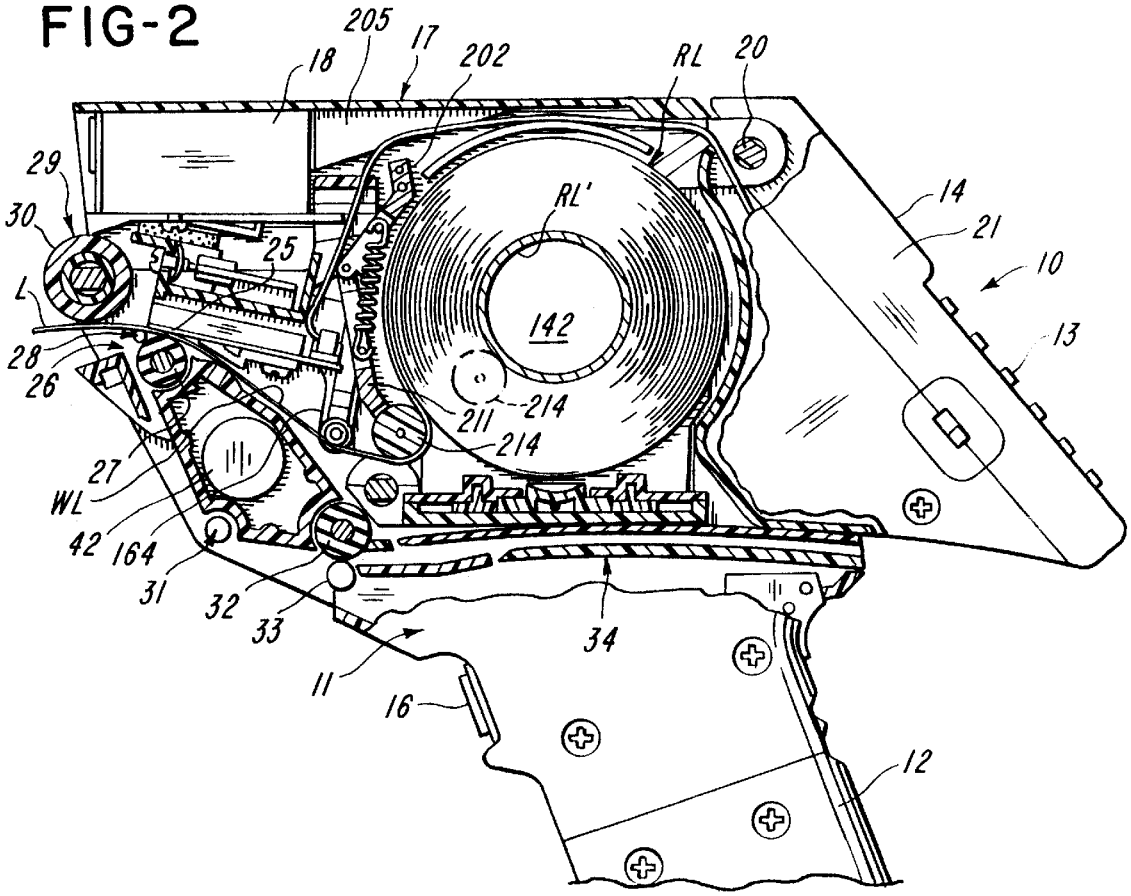
FIG. 2 is a fragmentary side elevational view of the apparatus shown in FIG. 1.

With reference to FIG. 2, there is shown a linerless-type label roll RL received in space in the housing 11. The roll RL is shown to have a core RL'. The core RL' is mounted on a pair of mounting members 142 (only one of which is shown) by which the roll RL is rotatably mounted. Any suitable arrangement for supporting the label roll RL can be used.

The apparatus 10 has a print station with a print head 25 and a platen 26. The platen 26 is shown to include a platen roll 27 which is driven by a motor 42 through gearing (not shown). Because the apparatus can print and apply liner-type label webs as well, there is provided a delaminator 28, the applicator 29 in the form of a roll 30, a guide roll 31, a driven feed roll 32 and a cooperating back-up roll 33, and an exit chute 34. It is noted that the cover 17 mounts a scanner 18. The cover 17 is pivotal about a pivot 20. Opening the cover affords access to the space inside the labeler 10 to load a roll RL or to remove a spent core RL'. The apparatus 10 of the foregoing description and the accompanying FIGS. 1 and 2 is more fully disclosed in U.S. Pat. No. 5,486,259 which is incorporated by reference, except that in U.S. Pat. No. 5,486,259 there is illustrated a composite label web C wound into a roll R, wherein the web C is comprised of labels L releasably adhered to a carrier web W. Many of the reference characters used herein are the same as the ones used in U.S. Pat. No. 5,486,259 for like components.

Figure 3:
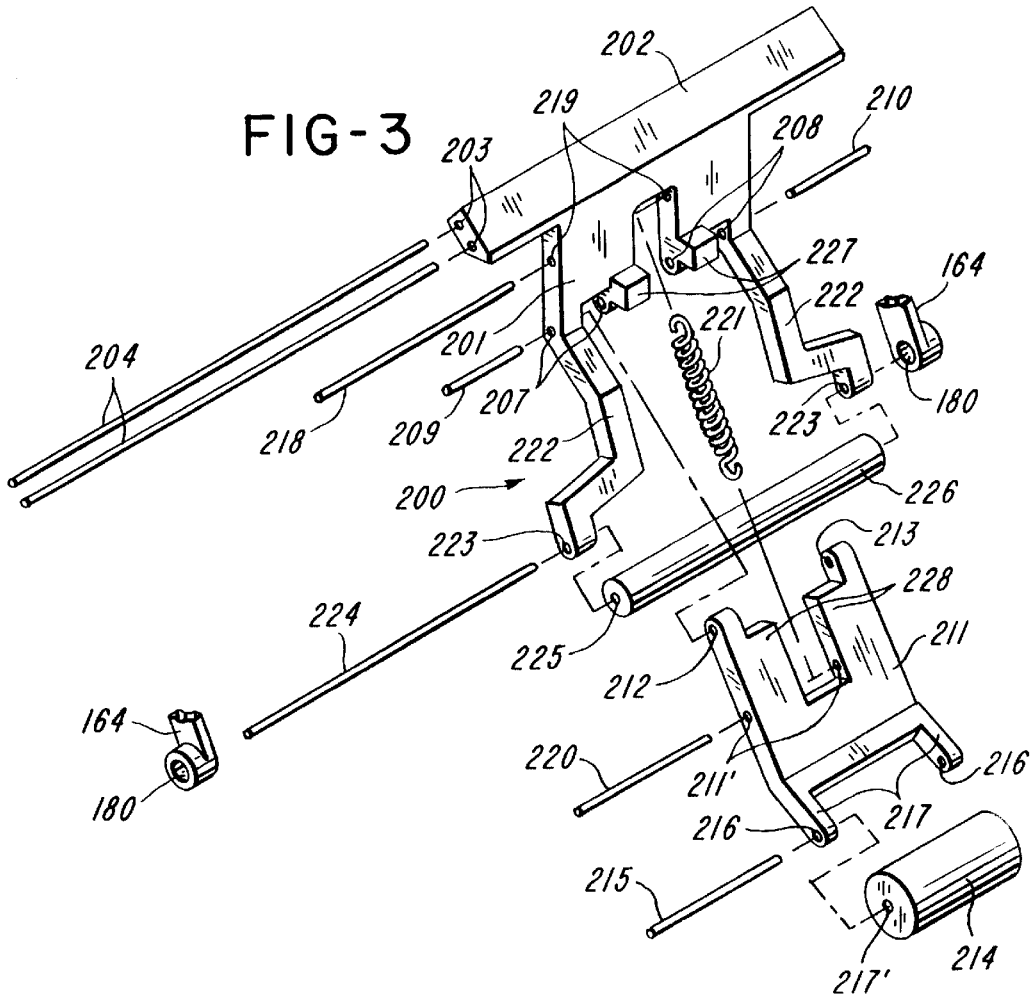
FIG. 3 is an exploded perspective view of a mechanism for mounting and biasing a peel roller.
Figure 4:
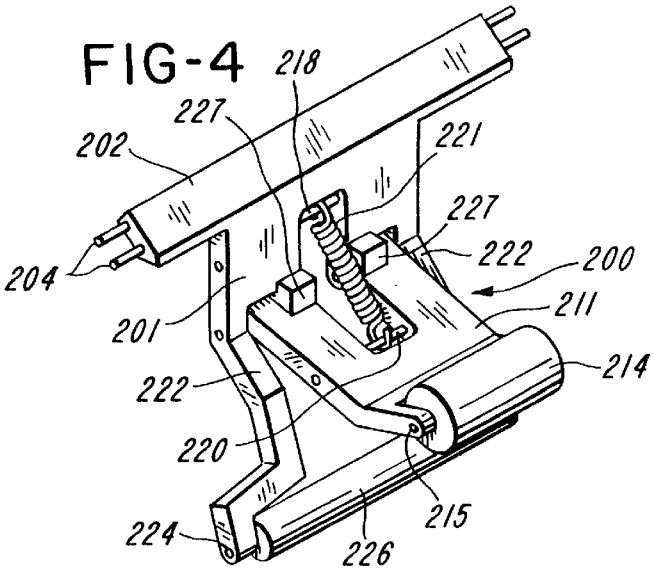
FIG. 4 is an assembled view of the mechanism shown in FIGS. 2 and 3 with a pivotal arm shown against a pair of stops.

With reference to FIGS. 3 and 4, there is shown a mechanism generally indicated at 200 having a bracket 201 with an integral mounting portion 202. The mounting portion 202 has a pair of through-holes 203 through which rods 204 extend. End portions of the rods 204 which project beyond the base portion 202 project into sides 205 and 206 of the cover 17 and secure the bracket 201 in place. The bracket 201 also has aligned pairs of through-holes 207 and 208 for receiving respective pins 209 and 210. An arm 211 has a pair of aligned through-holes 212 and 213. The pin 209 fits through the hole 212 and the pin 210 fits through the hole 213. The pins 209 and 210 mount the arm 211 for pivotal movement.

A peel roller 214 is rotatably mounted on a pin 215 received in holes 216 in projections 217 of the arm 211. The pin 215 passes through a through-hole 217' in the peel roller 214. The peel roller 214 is preferably composed of a relatively hard elastomeric material, but the roller 214 can be comprised of plastics, metal or other materials. A rod 220 passes through aligned through-holes 211' in the arm 211. A tension spring 221 is hooked around the rod 218 at its one end and around the rod 220 at its other end. The spring 221 biases the arm 211 and the peel roller which it carries counterclockwise as viewed in FIGS. 2, 3 and 4.

The bracket 201 also has spaced apart appendages 222 having aligned through-holes 223 through which a rod 224 passes. The rod 224 also passes through a hole 225 in a guide roller 226. End portions of the pin 224 extend short of holes 180 in arms 164.

The bracket 201 has a pair of stops 227. The arm 211 has faces 228 which bear against the respective stops 227 to limit the amount of pivotal movement of the arm 211. The stops 227 are positioned relative to the faces 228 so that the peel roller 214 can move between the full line position and the dotted line position in FIG. 2 without the faces 228 contacting the stops. The core RL' is depleted or nearly depleted in the dotted line position. This ensures that the peel roller 214 contacts the outer periphery of the roll RL irrespective of whether the roll RL is full or nearly depleted. If the roll RL is depleted, the peel roller 214 no longer needs to exert its pressure and thus the stops 227 bear against the faces 228 slightly counterclockwise of the place where the roll RL has been depleted. The stops 227 thus prevent the arm 211 and the peel roller 214 from moving too far counterclockwise which would interfere with closing of the cover 17. If desired, one stop 227 and one face 228 could be used instead of two.

As shown in FIG. 2, the peel roller 214 bears against the outer periphery of the linerless label roll RL. The linerless label web WL is peeled from the roll RL and passes partially around peel roller 214 as the platen roll 27 is driven. The web WL passes from the peel roller 214 preferably beneath the guide roll 226 and toward the nip between the print head 25 and the platen roll 27. From there the leading label L of the web WL exits the apparatus 10. As is preferred, the web WL has transverse lines of perforations which divide the web WL into a series of detachably connected labels L.

The peel roller 214 constrains the web WL to be peeled from the roll RL at a controlled location and prevents the web WL from leaving contact with the roll RL at different points or locations. The tangent point which the web WL loses contact with the roll RL remains essentially constant, as does the angle at which the web WL is peeled from the roll RL.

As shown, the web WL is wound face-side-out which means that the print head 25 will print on the outside of the web WL, the underside of the web WL being coated with a pressure sensitive adhesive.

In the event the apparatus 10 is used to print and apply labels of the liner type as in U.S. Pat. No. 5,486,259, the apparatus 10 is loaded with a composite label web roll. Such a composite web roll is preferably wound face-side-in so, as viewed in FIG. 2, the composite label web exits the label roll at the bottom and passes toward the print head 25 as the platen roll 27 rotates. The composite label web could even contact the lower surface of the peel roller 214 and the guide roller 226, but in this instance the peel roller 214 would be functioning solely as a guide roller, not as a peel roller. The carrier web would pass about the delaminator 28, which is also a peel roller, at which a label is dispensed beneath the applicator 29, from there partially about guide roller 31, from there to between rolls 32 and 33 and through the chute 34. Instead of going through the chute 34 the carrier web could exit in front of the handle 12.

If it is desired to wind the composite liner-type web face-side-out then the composite label web would pass partially around the peel roller 214 as with the web WL and from there the composite web would pass to between the print head 25 and platen roll 27.

When the apparatus 10 is used with linerless-type label webs as illustrated in FIG. 2, it is preferred that the peel roller 214 be relatively large, such as three-eighths of an inch, although other size peel rollers can be used.

Other embodiments and modifications of the invention will suggest themselves to those skilled in the art, and all such of these as come within the spirit of this invention are included within its scope as best defined by the appended claims.

We claim:

1. Apparatus for peeling of a linerless label web from a linerless label web roll, wherein the linerless web has a coating of pressure sensitive adhesive on one side and the other side being free of adhesive, comprising: a space in which a linerless label web roll can be rotatably mounted, a peel roller biased against the adhesive-free outer periphery of the roll, a driven roll, and wherein the driven roll draws the label web from the label web roll and partially about the peel roller.

2. Apparatus for peeling a linerless label web from a linerless label web roll, comprising: a rotatably mounted linerless label web roll with a coating of pressure sensitive adhesive on one side and the other side being free of adhesive, a peel roller biased against the adhesive-free outer periphery of the label roll irrespective of whether the label roll is full or nearly depleted, and a driven roll for drawing the label web from the label roll and partially about the peel roller.

3. Apparatus as defined in claim 2, including a housing, an arm pivotally mounted in the housing, the peel roller being rotatably mounted on the arm, and at least one spring for biasing the arm to urge the peel roller against the periphery of the label web roll.

4. Apparatus as defined in claim 3, including a stop for limiting travel of the arm and the peel roller.

5. Method of peeling a linerless label web from a label web roll, comprising the steps of: providing a linerless label web roll having a linerless label web with a coating of pressure sensitive adhesive on one side and the other side being free of adhesive, pressing a peel roller against the adhesive-free outer periphery of the label roll, and drawing the label web from the label roll and partially around the peel roller.

6. Apparatus for printing on a linerless label web, comprising: a space for rotatably mounting a label roll having a linerless label web with a coating of pressure sensitive adhesive on one side and the other side being free of adhesive, a print head and a cooperable driven platen roll, a peel roller biased against the adhesive-free outer periphery of the label roll irrespectively of whether the label roll is full or nearly depleted, and wherein the platen roll draws the label web from the label roll and partially about the peel roller.

7. Apparatus as defined in claim 6, including a pivotal arm for rotatably mounting the peel roller, and at least one spring for biasing the peel roller against the outer periphery of the label roll.

8. Apparatus as defined in claim 7, and at least one stop to limit the movement of the pivotal arm.

9. Apparatus for selectively printing on either on a linerless-type label web wound into a linerless type label roll with a coating of pressure sensitive adhesive on one side and a printable adhesive-free face on the other side or a liner-type label web having labels releasably adhered to a carrier web by pressure sensitive adhesive and wound into a liner-type label roll, comprising: a space for either a linerless-type label roll or a liner-type label roll, a peel roller biased against the adhesive-free outer periphery of either a linerless-type label roll or a liner-type label roll, a driven platen roll, a print head cooperable with the platen roll to print on either the linerless-type label web or a liner-type label web, wherein the linerless-type label roll is wound face-side-out, wherein the platen roll can draw the linerless-type label web from the linerless-type label roll and partially about the peel roller, wherein the liner-type label web is wound face-side-in, and wherein the liner-type label web can bypass the peel roller or the peel roller can act as a guide, and a delaminator for peeling the printed labels from the carrier web.

10. Hand-held apparatus for selectively printing on either a linerless-type label web wound into a linerless-type label roll with a coating of pressure sensitive adhesive on one side and a printable adhesive-free face on the other side or on a liner-type label roll, comprising: a housing having a handle, the housing including a space for either a linerless-type label roll or a liner-type label roll, a print head for printing on either a linerless-type label web or on a liner-type label web, a driven platen roll cooperable with the print head, a peel roller biased against the adhesive-free outer periphery of either a linerless-type label roll or a liner-type label roll, wherein the linerless-type label roll is wound face-side-out and adhesive-side-in, wherein the driven platen roll can draw the linerless-type label web from the linerless-type label roll and partially about the peel roller or can draw the liner-type label web from the liner-type label roll, and a delaminator for peeling the printed labels from the carrier web of the liner-type label web.

11. Apparatus for selectively printing on either a linerless-type label web wound into a linerless-type label roll or on a liner-type label web having labels releasably adhered to a carrier web and wound into a liner-type label roll, comprising: a space for either a linerless-type label roll or a liner-type label roll, a print head for printing on either a linerless-type label web or on a liner-type label web, a driven platen roll cooperable with the print head, a peel roller biased against the outer periphery of either a linerless-type label roll or a liner-type label roll, wherein the linerless-type label roll is wound face-side-out, wherein the driven platen roll can draw the linerless-type label web from the linerless-type label roll and partially about the peel roller or can draw the liner-type label web from the liner-type label roll, and a delaminator for peeling the printed labels from the carrier web of the liner-type label web.

12. Method of selectively printing on either a linerless-type label web wound into a linerless-type label roll or on a liner-type label web having labels releasably adhered to a carrier web and wound into a liner-type label roll, comprising the steps of: providing either a linerless-type label roll or a liner-type label roll, biasing a peel roller against the outer periphery of either the linerless-type label roll or the liner-type label roll, drawing the linerless-type label web partially about the peel roller to a printing station, or drawing the liner-type label web from the liner-type label roll to the printing station and thereafter delaminating labels from the carrier web.

13. Method as defined in claim 12, wherein the liner-type label web effectively bypasses the peel roller.

14. Method as defined in claim 13, wherein the linerless-type label roll is wound face-side-out and the liner-type label roll is wound face-side-in.

15. Apparatus for printing on a linerless label web, comprising: a housing, a space within the housing for receiving a label roll of a linerless label web with a coating of pressure sensitive adhesive on one side with the other side being adhesive-free, a print head, a closable cover movable to afford access to the space to load a label roll, a peel roller mounted to the cover and biased against the adhesive-free outer periphery of the label roll, and a driven roll for drawing the label web from the label roll and partially about the peel roller to the print head.

16. Apparatus for printing on a linerless label web, comprising: a housing, a space within the housing for receiving a label roll of a linerless label web with a coating of pressure sensitive adhesive on one side with the other side being adhesive-free, a print head, the housing having a cover movable to afford access to the space to load a label roll, a peel roller mounted to the cover and biased against the adhesive-free outer periphery of the label roll, a driven roll for drawing the label web from the label roll and partially about the peel roller to the print head, and a stop to prevent the peel roller from moving too far when closing the cover.

17. Apparatus for printing on a linerless label web, comprising: a housing having a handle, a space within the housing for receiving a label roll of a linerless label web with a coating of pressure sensitive adhesive on one side with the other side being adhesive-free, a print head, the housing having a cover movable to afford access to the space to load a label roll, a peel roller mounted to the cover and biased against the adhesive-free outer periphery of the label roll, and a driven roll for drawing the label web from the label roll and partially about the peel roller to the print head.

* * * * *